US010168089B2

(12) United States Patent
Yang

(10) Patent No.: US 10,168,089 B2
(45) Date of Patent: Jan. 1, 2019

(54) REFRIGERATOR

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/462,699

(22) Filed: Mar. 17, 2017

(65) Prior Publication Data

US 2017/0292746 A1 Oct. 12, 2017

(30) Foreign Application Priority Data

Apr. 11, 2016 (KR) ..... 10-2016-0044325

(51) Int. Cl.

| | |
|---|---|
| ***F25C 1/04*** | (2018.01) |
| ***F25C 1/25*** | (2018.01) |
| ***F25C 5/182*** | (2018.01) |
| ***F25C 5/185*** | (2018.01) |
| ***F25D 23/04*** | (2006.01) |
| ***F25D 23/06*** | (2006.01) |
| *F25B 5/02* | (2006.01) |

(52) U.S. Cl.

CPC ..... *F25C 1/04* (2013.01); *F25C 1/25* (2018.01); *F25C 5/182* (2013.01); *F25C 5/185* (2013.01); *F25D 23/04* (2013.01); *F25D 23/061* (2013.01); *F25B 5/02* (2013.01)

(58) Field of Classification Search

CPC ..... F25C 1/04; F25C 1/225; F25C 2400/14; F25C 5/182; F25C 1/25; F25C 5/185; F25B 5/02; F25B 1/00; F25B 41/003; F25B 41/04; F25D 17/04; F25D 23/04; F25D 23/061

USPC ..... 62/66, 76, 335, 340, 344

See application file for complete search history.

(56) References Cited

U.S. PATENT DOCUMENTS 6,293,107 B1 * 9/2001 Kitagawa ..... F25B 21/02 62/3.2
2009/0260371 A1 * 10/2009 Kuehl ..... F25B 25/005 62/79

FOREIGN PATENT DOCUMENTS

| | | |
|---|---|---|
| KR | 10-0716254 B1 | 5/2007 |
| KR | 10-2009-0012687 | 2/2009 |
| KR | 10-2010-0113207 | 10/2010 |
| KR | 10-2012-0033536 | 4/2012 |
| WO | 2009/017286 | 2/2009 |

* cited by examiner

*Primary Examiner* — Melvin Jones

(57) ABSTRACT

A refrigerator includes a refrigerator main body configured to define an outer shell of the refrigerator and a door configured to open and close an internal space of the refrigerator main body. The refrigerator further includes an ice-making unit provided in the door and a cold air generation unit configured to circulate a refrigerant so that a cold air is supplied to the internal space. The refrigerator further includes an ice-making pipe installed within the ice-making unit so that the ice-making unit makes heat exchange with the refrigerant, a refrigerant pipe installed in the refrigerator main body so as to receive the refrigerant from the cold air generation unit, and a soft pipe disposed around a folding portion of the refrigerator main body and the door and configured to interconnect the ice-making pipe and the refrigerant pipe in a stretchable manner.

8 Claims, 4 Drawing Sheets

REFRIGERATOR

CROSS-REFERENCE TO RELATED APPLICATION

This application is based on and claims priority from Korean Patent Application No. 10-2016-0044325, filed on Apr. 11, 2016, the disclosure of which is incorporated herein in its entirety by reference for all purposes.

TECHNICAL FIELD

The present disclosure relates to a refrigerator.

BACKGROUND

A refrigerator is an apparatus for use in storing food at a low temperature and may be configured to store food in a frozen state or a refrigerated state depending on the kinds of food to be stored.

The interior of the refrigerator is cooled by a continuously-supplied cold air. The cold air is continuously generated by a heat exchange action of a refrigerant which goes through a freezing cycle consisting of compression, condensation, expansion and evaporation. The cold air supplied into the refrigerator is uniformly transferred to the interior of the refrigerator by convection and is used to store food at a desired temperature within the refrigerator.

The refrigerator includes a main body having a rectangular parallelepiped shape with a front surface thereof opened. A refrigeration compartment and a freezing compartment may be provided within the main body. A refrigeration compartment door and a freezing compartment door for selectively shielding opening portions may be provided on the front surface of the main body. Drawers, racks, storage boxes and the like for storing different kinds of food in an optimal state may be provided in the internal storage spaces of the refrigerator.

In general, top-mount-type refrigerators each having a freezing compartment positioned at the upper side and a refrigeration compartment positioned at the lower side constitute the mainstream of refrigerators. In recent years, there are commercially available bottom-freeze-type refrigerators in which a freezing compartment is positioned at the lower side in order to enhance the user convenience. In the case of the bottom-freeze-type refrigerators, the frequently-used refrigeration compartment is positioned at the upper side and the less-frequently-used freezing compartment is positioned at the lower side. This provides an advantage of enabling a user to conveniently use the refrigeration compartment. However, in the bottom-freeze-type refrigerators, the freezing compartment is positioned at the lower side. Thus, the bottom-freeze-type refrigerators are inconvenient to use because a user should bend the body in order to open a freezing compartment door and to take out ice pieces.

In order to solve this problem, there is commercially available a bottom-freeze-type refrigerator in which a dispenser for taking out ice pieces is provided in a refrigeration compartment door positioned at the upper side of the refrigerator. In this case, an ice-making device for producing ice pieces may be provided in the refrigeration compartment door or the interior of the refrigeration compartment.

In the case of the bottom-freeze-type refrigerator in which an ice-making device is installed in a refrigeration compartment door, an air (cold air) cooled by a evaporator is divisionally discharged into a freezing compartment and refrigeration compartment. The cold air discharged toward the freezing compartment flows toward the ice-making device along a cold air supply duct embedded in a sidewall of a refrigerator main body. Then, the cold air cools water into ice pieces while flowing through the interior of the ice-making device. Thereafter, the cold air existing within the ice-making device is discharged into the refrigeration compartment via a cold air return duct embedded in the sidewall of the refrigerator main body, thereby lowering the internal temperature of the refrigeration compartment.

However, in the case of the refrigerator of the related art, the cold air supply duct, the cold air return duct and a structure for insulating the ducts need to be added to the left or right wall surface portion of the refrigeration compartment. Thus, the volume of the refrigerator may be reduced and the internal pipe arrangement structure of the refrigerator may be complex.

Furthermore, the production of ice pieces in the refrigerator door is performed by an indirect cooling method using the cold air flowing through the cold air supply duct. Thus, the water existing in the refrigerator door is not directly cooled by a refrigerant. This may reduce the ice-making speed.

PRIOR ART DOCUMENTS

Patent Documents

Patent Document: Korean Patent No. 10-0565621 (registered on Mar. 22, 2006) 15

SUMMARY

Embodiments of the present disclosure provide a refrigerator capable of making ice pieces within an ice-making compartment of a door by a direct cooling method using a refrigerant.

In accordance with a first aspect of the present disclosure, there is provided a refrigerator, including: a refrigerator main body configured to define an outer shell of the refrigerator; a door configured to open and close an internal space of the refrigerator main body; an ice-making unit provided in the door; a cold air generation unit configured to circulate a refrigerant so that a cold air is supplied to the internal space; an ice-making pipe installed within the ice-making unit so that the ice-making unit makes heat exchange with the refrigerant; a refrigerant pipe installed in the refrigerator main body so as to receive the refrigerant from the cold air generation unit; and a soft pipe disposed around a folding portion of the refrigerator main body and the door and configured to interconnect the ice-making pipe and the refrigerant pipe in a stretchable manner.

The soft pipe may be configured to interconnect the ice-making pipe and the refrigerant pipe in an opening/closing direction of the door.

The refrigerant pipe may be branched from the cold air generation unit so that an end portion of the refrigerant pipe is horizontally installed in a side wall of the refrigerator main body.

The cold air generation unit may include: an evaporator in which an air makes heat exchange with the refrigerant so that a cold air is supplied to the internal space of the refrigerator main body; a compressor configured to phase-change the refrigerant supplied from the evaporator to a gaseous refrigerant having a high temperature and a high pressure; a condenser configured to phase-change the gaseous refrigerant to a liquid refrigerant having a high pressure; and an expansion valve configured to depressurize the liquid refrigerant and to supply the liquid refrigerant to the evaporator.

The ice-making unit may include: an ice-making compartment configured to provide an ice-making space; an ice-making tray configured to provide a frame which makes contact with the ice-making pipe so that ice pieces are produced through heat exchange with the refrigerant; and an ice bucket positioned under the ice-making tray so as to store the ice pieces.

The ice-making unit may further include a heater disposed in a peripheral edge portion of the ice-making tray.

The refrigerator may further includes a pipe case configured to surround an end portion of the refrigerant pipe.

In accordance with a second aspect of the present disclosure, there is provided a refrigerator, including: a refrigerator main body configured to define an outer shell of the refrigerator; a door configured to open and close an internal space of the refrigerator main body; an ice-making unit provided in the door; a cold air generation unit configured to circulate a refrigerant so that a cold air is supplied to the internal space; an ice-making pipe installed within the ice-making unit so that the ice-making unit makes heat exchange with the refrigerant; a refrigerant pipe branched from the cold air generation unit so that an end portion of the refrigerant pipe is horizontally installed in a side wall of the refrigerator main body; and a soft pipe configured to interconnect the ice-making pipe and the refrigerant pipe in a stretchable manner.

The ice-making unit may include: an ice-making compartment configured to provide an ice-making space; an ice-making tray configured to provide a frame which makes contact with the ice-making pipe so that ice pieces are produced through heat exchange with the refrigerant; and an ice bucket positioned under the ice-making tray so as to store the ice pieces.

According to the embodiments of the present disclosure, the refrigerant in the refrigerator-main-body-side refrigerant pipe is supplied to the refrigerator-door-side ice-making pipe. Thus, the production of ice pieces in the refrigerator door may be performed by a direct cooling method using a refrigerant. As a result, it is possible to improve the cooling efficiency of ice pieces and to enhance the consumption efficiency of the energy consumed in a cooling process. In addition, it is possible to increase the ice-making speed.

BRIEF DESCRIPTION OF THE DRAWINGS

Embodiments of the present invention will be better understood from a reading of the following detailed description, taken in conjunction with the accompanying figures, in which like reference characters designate like elements and in which.

DETAILED DESCRIPTION

Figure 1:
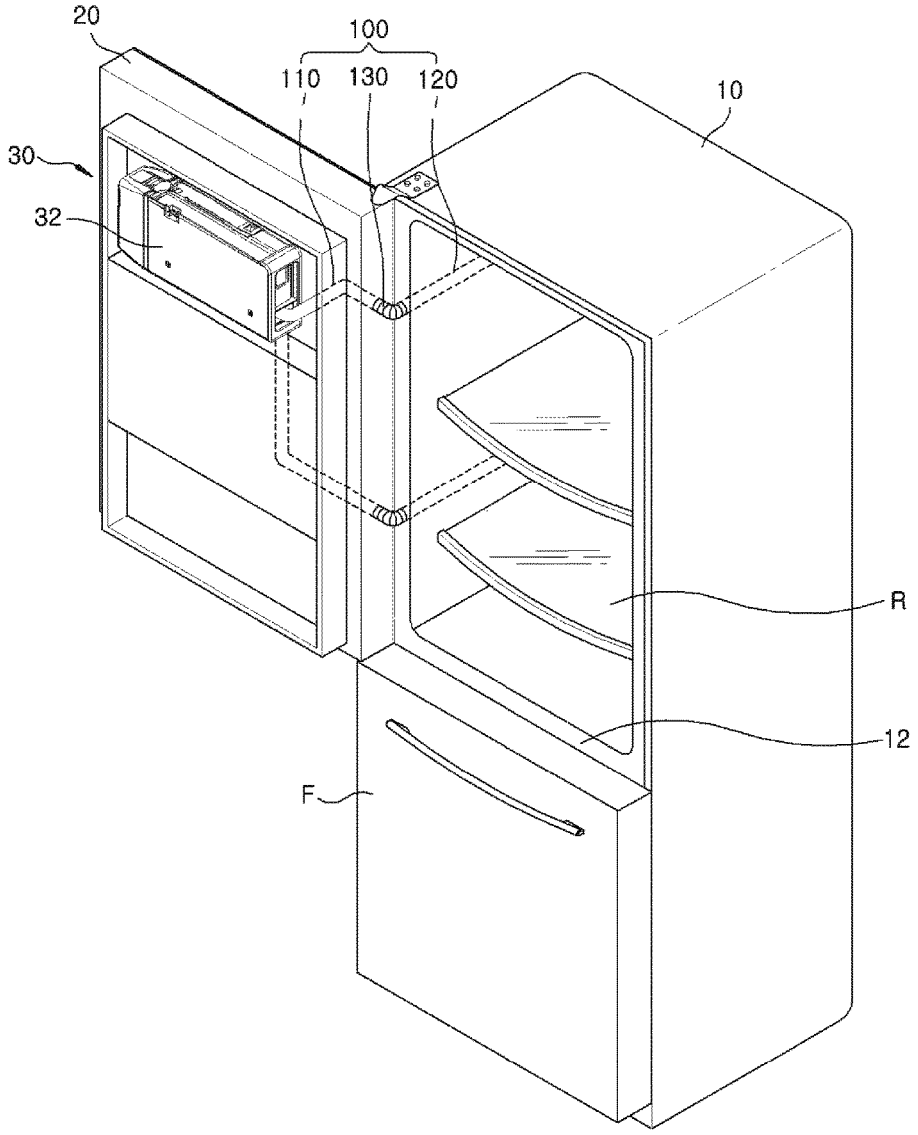
FIG. 1 is a perspective view illustrating a refrigerator according to one embodiment of the present disclosure.

Hereinafter, configurations and operations of embodiments will be described in detail with reference to the accompanying drawings. The following description is one of various patentable aspects of the disclosure and may form a part of the detailed description of the disclosure.

However, in describing the disclosure, detailed descriptions of known configurations or functions that make the disclosure obscure may be omitted.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another. When it is said that a component is "connected" or "linked" to another component, it should be understood that the former component may be directly connected or linked to the latter component or a third component may be interposed between the two components. Specific terms used in the present application are used simply to describe specific embodiments without limiting the disclosure. An expression used in the singular encompasses the expression of the plural, unless it has a clearly different meaning in the context.

Hereinafter, one embodiment of the present disclosure will be described with reference to the accompanying drawings.

Figure 2:
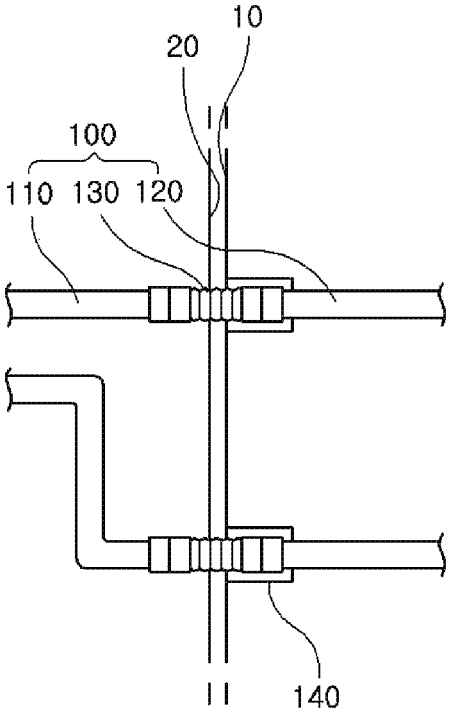
FIG. 2 is a view illustrating a connection state of an ice-making pipe, a refrigerant pipe and a soft pipe in the refrigerator according to one embodiment of the present disclosure.
Figure 3:
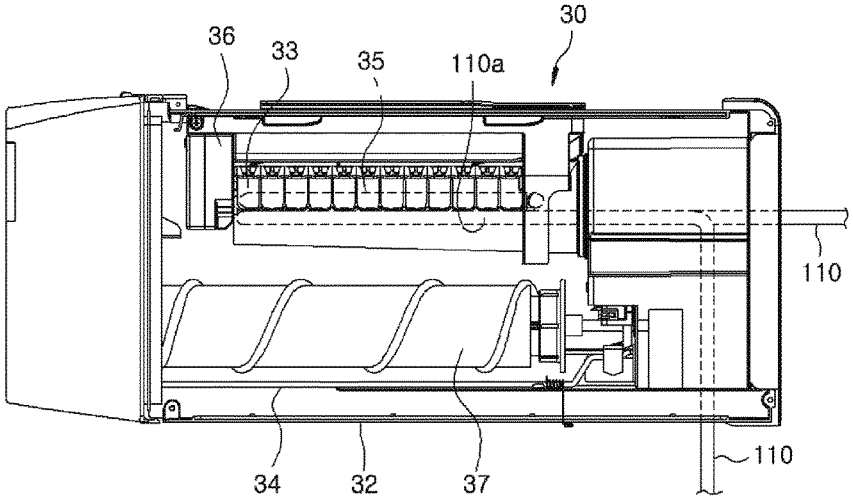
FIG. 3 is a side sectional view illustrating the internal configuration of an ice-making unit of the refrigerator illustrated in FIG. 1.
Figure 4:
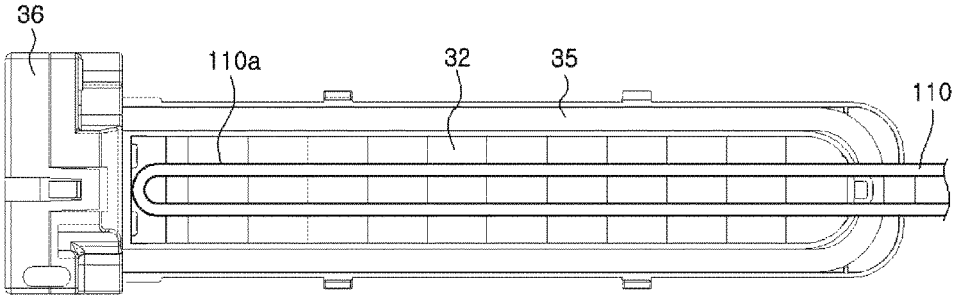
FIG. 4 is a plan view illustrating the internal configuration of an ice-making unit of the refrigerator illustrated in FIG. 1.

FIG. 1 is a perspective view illustrating a refrigerator according to one embodiment of the present disclosure. FIG. 2 is a view illustrating a connection state of an ice-making pipe, a refrigerant pipe and a soft pipe in the refrigerator according to one embodiment of the present disclosure. FIG. 3 is a side sectional view illustrating the internal configuration of an ice-making unit of the refrigerator illustrated in FIG. 1. FIG. 4 is a plan view illustrating the internal configuration of an ice-making unit of the refrigerator illustrated in FIG. 1.

As illustrated in FIGS. 1 to 4, the refrigerator according to one embodiment of the present disclosure may include a refrigerator main body 10 configured to define an outer shell of the refrigerator, a door 20 configured to open and close an internal space of the refrigerator main body 10, an ice-making unit 30 provided in the door 20, a cold air generation unit 40 configured to circulate a refrigerant, and a direct cooling unit 100 configured to supply the refrigerant of the cold air generation unit 40 to the ice-making unit 130 via a stretchable soft pipe 130.

Specifically, the refrigerator main body 10 is a housing configured to define an outer shell of the refrigerator and may be partitioned into a freezing compartment F and a refrigeration compartment R by a barrier 12. For example, the freezing compartment F may be provided in a lower portion of the refrigerator main body 10 and the refrigeration compartment R may be provided in an upper portion of the refrigerator main body 10. The freezing compartment F and the refrigeration compartment R may be opened and closed by the door 20.

The door 20 may include a refrigeration compartment door configured to selectively shield the refrigeration compartment R at the opposite edges of the front surface of the refrigerator main body 10 and a freezing compartment door configured to shield the opening of the front surface of the freezing compartment F.

In the present embodiment, there is described, by way of example, a case where the refrigeration compartment door provided with the ice-making unit 30 is configured to open and close the refrigeration compartment R. However, it is not intended to exclude a case where the ice-making unit 30 is provided in the freezing compartment door configured to selectively shield the freezing compartment F. In addition, the refrigerator according to the present embodiment is a bottom-freeze-type refrigerator in which the freezing compartment F is positioned at the lower side. However, the present disclosure is not limited thereto. It goes without saying that the present disclosure may be applied to different types of refrigerators.

The ice-making unit 30 may include an ice-making compartment 32 configured to provide an ice-making space for producing ice pieces, an ice-making tray 33 configured to exchange heat with the refrigerant to produce ice pieces, an ice bucket 34 positioned under the ice-making tray 33, a rotary motor 36 configured to rotate the ice-making tray 33 to drop the ice pieces produced in the ice-making tray 33 onto the ice bucket 34, and a heater 35 provided in a peripheral edge portion of the ice-making tray 33.

In this regard, the ice-making tray 33 is configured to provide a space in which the water received from a water supply pipe (not shown) is cooled into ice pieces. A plurality of molding spaces capable of accommodating water may be formed on the upper surface of the ice-making tray 33. The molding spaces may have different shape depending on the shape of ice pieces to be produced. The number of the molding spaces may also be diversely changed.

The ice-making tray 33 may be made of metal having high heat conductivity. The lower surface of the ice-making tray 33 may make contact with an ice-making pipe 110. The ice-making pipe 110 making contact with the ice-making tray 33 may have a U-shaped contact portion 110*a*. For example, the contact portion 110*a* of the ice-making pipe 110 may begin to extend from one end of the ice-making tray 33 and may be bent 180 degrees in the vicinity of the other end of the ice-making tray 33. Then, the contact portion 110*a* may extend toward one end of the ice-making tray 33.

Needless to say, the present disclosure is not limited thereto. The contact portion 110*a* of the ice-making pipe 110 may be bent multiple times and may be formed to reciprocate multiple times on the lower surface of the ice-making tray 33. In order to enhance the heat transfer efficiency, the ice-making tray 33 and the ice-making pipe 110 may be strongly combined by an adhesive agent or a fastener.

Thus, the refrigerant supplied from the refrigerant pipe 120 to the ice-making pipe 110 makes direct heat exchange with the water contained in the ice-making tray 33, in the contact portion 110*a* of the ice-making pipe 110, thereby cooling the water. The water thus cooled may be phase-changed to ice pieces. In other words, the contact portion 110*a* of the ice-making pipe 110 may perform a function just like a small evaporator in a freezing cycle.

As described above, in the present embodiment, the ice pieces may be produced by a direct cooling method through the solid-to-solid heat exchange between the ice-making pipe 110 and the ice-making tray 33. On the other hand, in the case of a refrigerator of the related art, a cold air supplied from a refrigerator main body is supplied to an ice-making tray of an ice-making unit to produce ice pieces by an indirect cooling method through the gas-to-solid heat exchange. Thus, in the present disclosure, as compared with the related art, it is possible to significantly shorten the ice production time through the superior heat exchange performance of the direct cooling method.

The ice pieces thus produced may be dropped by the rotary motor 36 onto the ice bucket 34 disposed under the ice-making tray 33. At this time, the heater 35 may heat the surface of the ice-making tray 33 for a short period of time, thereby slightly melting the surfaces of the ice pieces adhering to the ice-making tray 33 so that the ice pieces are easily separated from the ice-making tray 33.

If the upper surface of the ice-making tray 33 is rotated toward the ice bucket 34, the ice-making tray 33 is twisted at a predetermined angle or more. Due to the twisting of the ice-making tray 33, the ice pieces accommodated in the ice-making tray 33 may be dropped into the ice bucket 34. The ice pieces stacked in the ice bucket 34 are inserted into between blades of an auger 37. When the auger 37 is rotated, the ice pieces may be supplied to a user through a dispenser (not shown) provided in the door 20.

The direct cooling unit 100 may include an ice-making pipe 110 installed in the ice-making unit 30, a refrigerant pipe 120 installed in the refrigerator main body 10, a soft pipe 130 configured to flexibly interconnect the ice-making pipe 110 and the refrigerant pipe 120, and a pipe case 140 configured to surround an end portion of the refrigerant pipe 120.

The ice-making pipe 110 may be installed in the ice-making compartment 32 so that at least a portion (e.g., the contact portion 110*a*) of the ice-making pipe 110 makes contact with the ice-making tray 33 of the ice-making unit 30. Thus, the refrigerant supplied to the ice-making pipe 110 may rapidly cool the water by making direct heat exchange with the water contained in the ice-making tray 33, in the contact portion 110*a* of the ice-making pipe 110.

The refrigerant pipe 120 is a pipe branched from a refrigerant line 45 of the cold air generation unit 40. The refrigerant pipe 120 may be branched from the cold air generation unit 40 so that the end portion of the refrigerant pipe 120 is horizontally installed in a side wall of the refrigerator main body 10. The refrigerant pipe 120 may include an inflow refrigerant pipe configured to supply the refrigerant from the cold air generation unit 40 to the ice-making pipe 110 and an outflow refrigerant pipe configured to return the refrigerant from the ice-making pipe 110 to the cold air generation unit 40.

The refrigerant pipe 120 is connected to the ice-making pipe 110 via the soft pipe 130. It is therefore possible for the refrigerant pipe 120 to supply the refrigerant from the cold air generation unit 40 to the ice-making pipe 110 and to return the refrigerant from the ice-making pipe 110 to the cold air generation unit 40. Thus, the refrigerant supplied from the refrigerant line 45 to the refrigerant pipe 120 may flow toward the ice-making pipe 110 via the soft pipe 130 and may cool the ice-making unit 30. Thereafter, the refrigerant may flow toward the refrigerant line 45 via the soft pipe 130 and the ice-making pipe 110.

The soft pipe 130 may be a refrigerant hose configured to interconnect the ice-making pipe 110 and the refrigerant pipe 120 in the opening/closing direction of the door 20 in a region around a folding portion of the refrigerator main body 10 and the door 20. For example, the soft pipe 130 may be a refrigerant hose made of a twistable flexible material and may be fastened to the end portions of the ice-making pipe 110 and the refrigerant pipe 120.

In particular, the soft pipe 130 is manufactured in a four-layer structure including an outer rubber layer, a reinforcing layer, an inner rubber layer and a resin layer (nylon layer). Thus, the soft pipe 130 may reduce a loss of a cold air and may effectively deliver the refrigerant from the refrigerant pipe 120 installed in the refrigerator main body 10 to the ice-making pipe 110 installed in the door 20, while actively coping with the opening/closing operation of the door 20.

The pipe case 140 is a case configured to protect the end portion of the refrigerant pipe 120. A foam material such as urethane foam or the like for heat insulation may be filled in the pipe case 140. Since the pipe case 140 is configured to shield a fastening portion between the refrigerant pipe 120 and the soft pipe 130, it is possible to improve the quality of outward appearance. A case cover (not shown) for opening and closing an internal space may be installed in the pipe case 140.

Figure 5:
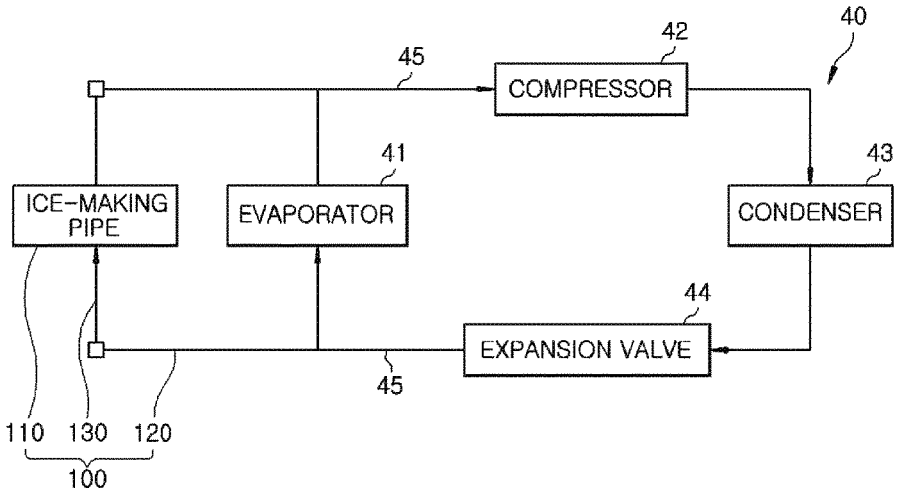
FIG. 5 is a block diagram illustrating a cold air generation unit of the refrigerator according to one embodiment of the present disclosure.

FIG. 5 is a block diagram illustrating the cold air generation unit of the refrigerator according to one embodiment of the present disclosure.

As illustrated in FIG. 5, the cold air generation unit 40 may supply a cold air, which is generated through heat exchange between the refrigerant and the air existing within a cooling duct (not shown), to the refrigeration compartment and the freezing compartment.

For this purpose, the cold air generation unit 40 may include an evaporator 41, a compressor 42 configured to phase-change the refrigerant discharged from the evaporator 41 to a gaseous refrigerant having a high temperature and a high pressure, a condenser 43 configured to phase-change the gaseous refrigerant to a liquid refrigerant having a high pressure, and an expansion valve 44 configured to adiabatically expand the liquid refrigerant and to supply the expanded liquid refrigerant to the evaporator 41.

A heat exchange action of the refrigerant according to a freezing cycle (consisting of compression, condensation, expansion and evaporation) occurs in the compressor 42, the condenser 43, the expansion valve 44 and the evaporator 41. Thus, the air existing within the cooling duct may be cooled into a cold air through the heat exchange with the refrigerant of the evaporator 41. In the regard, the configurations of the compressor 42, the condenser 43 and the expansion valve 44 may share the freezing cycle for supplying the refrigerant to the direct cooling unit 100.

That is to say, a part of the refrigerant may supply a cold air to the freezing compartment and the refrigeration compartment while circulating through the freezing cycle composed of the evaporator 41, the compressor 42, the condenser 43 and the expansion valve 44 along the refrigerant line 45. Another part of the refrigerant may be diverted to the ice-making pipe 110 through the refrigerant pipe 120 to cool the ice-making unit 30 and, then, may be circulated through the freezing cycle composed of the evaporator 41, the compressor 42, the condenser 43 and the expansion valve 44.

Hereinafter, descriptions will be made on the operation of the refrigerator according to the present embodiment configured as described above.

First, if a part of the refrigerant constituting the freezing cycle of the refrigerator is diverted from the refrigerant line 45 to the refrigerant pipe 120, the refrigerant existing within the refrigerant pipe 120 may flow toward the ice-making pipe 110 through the soft pipe 130. In this regard, the soft pipe 130 is made of a material which can be extended and contracted in the opening/closing direction of the door 20. Thus, the refrigerant may smoothly flow between the refrigerant pipe 120 and the ice-making pipe 110 regardless of the opening/closing operation of the door 20.

The refrigerant moved to the ice-making pipe 110 may directly cool the ice-making tray 33 through the contact portion 110*a*. At this time, the water supplied to the ice-making tray 33 is directly cooled by the contact portion 110*a* and is consequently phase-changed. Thus, the ice pieces may be produced rapidly. The ice pieces produced in the ice-making tray 33 may be dropped onto the ice bucket 34 disposed under the ice-making tray 33 and, then, may be supplied to a user through the dispenser of the door 20.

The refrigerant existing within the ice-making pipe 110, which has exchanged heat with the ice-making tray 33, may be moved to the refrigerant pipe 120 through the soft pipe 130. The refrigerant moved to the refrigerant pipe 120 may enter the freezing cycle of the refrigerator through the refrigerant line 45.

As described above, according to the present disclosure, the refrigerant in the refrigerator-main-body-side refrigerant pipe is supplied to the refrigerator-door-side ice-making pipe. Thus, the production of ice pieces in the refrigerator door may be performed by a direct cooling method using a refrigerant. As a result, it is possible to improve the cooling efficiency of ice pieces and to enhance the consumption efficiency of the energy consumed in a cooling process. In addition, it is possible to increase the ice-making speed.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator, comprising:

a refrigerator main body configured to define an outer shell of the refrigerator;

a door configured to open and close an internal space of the refrigerator main body;

an ice-making unit provided in the door;

a cold air generation unit configured to circulate a refrigerant so that a cold air is supplied to the internal space;

an ice-making pipe installed within the ice-making unit so that he ice-making unit makes heat exchange with the refrigerant;

a refrigerant pipe installed in the refrigerator main body so as to receive the refrigerant from the cold air generation unit; and a soft pipe disposed around a folding portion of the refrigerator main body and the door and configured to interconnect the ice-making pipe and the refrigerant pipe in a stretchable manner, wherein the soft pipe is configured to interconnect the ice-making pipe and the refrigerant pipe in a stretchable manner.

2. The refrigerator of claim 1, wherein the refrigerant pipe is branched from the cold air generation unit so that an end portion of the refrigerant pipe is horizontally installed in a side wall of the refrigerator main body.

3. The refrigerator of claim 1, wherein the cold air generation unit includes:

an evaporator in which an air makes heat exchange with the refrigerant so that a cold air is supplied to the internal space of the refrigerator main body;

a compressor configured to phase-change the refrigerant supplied from the evaporator to a gaseous refrigerant having a high temperature and a high pressure;

a condenser configured to phase-change the gaseous refrigerant to a liquid refrigerant having a high pressure; and an expansion valve configured to depressurize the liquid refrigerant and to supply the liquid refrigerant to the evaporator.

4. The refrigerator of claim 1, wherein the ice-making unit includes:

an ice-making compartment configured to provide an ice-making space;

an ice-making tray configured to provide a frame which makes contact with the ice-making pipe so that ice pieces are produced through heat exchange with the refrigerant; and an ice bucket positioned under the ice-making tray so as to store the ice pieces.

5. The refrigerator of claim 4, wherein the ice-making unit further includes:

a heater disposed in a peripheral edge portion of the ice-making tray.

6. The refrigerator of claim 1, further comprising:

a pipe case configured to surround an end portion of the refrigerant pipe.

7. A refrigerator, comprising:

a refrigerator main body configured to define an outer shell of the refrigerator;

a door configured to open and close an internal space of the refrigerator main body;

an ice-making unit provided in the door;

a cold air generation unit configured to circulate a refrigerant so that a cold air is supplied to the internal space;

an ice-making pipe installed within the ice-making unit so that the ice-making unit makes heat exchange with the refrigerant;

a refrigerant pipe branched from the cold air generation unit so that an end portion of the refrigerant pipe is horizontally installed in a side wall of the refrigerator main body; and a soft pipe configured to interconnect the ice-making pipe and the refrigerant pipe in a stretchable manner.

8. The refrigerator of claim 7, wherein the ice-making unit includes:

an ice-making compartment configured to provide an ice-making space;

an ice-making tray configured to provide a frame which makes contact with the ice-making pipe so that ice pieces are produced through heat exchange with the refrigerant; and an ice bucket positioned under the ice-making tray so as to store the ice pieces.

* * * * *